United States Patent [19]

Bradbury et al.

[11] 4,200,455

[45] Apr. 29, 1980

[54] HYDROMETALLURGICAL RECOVERY OF METAL VALUES

[75] Inventors: James A. Bradbury, Tucson, Ark.; John C. Stauter, Edmond, Okla.; Richard T. Um, Tucson, Ark.; Frank A. Stephens, Tucson, Ark.; Yoon T. Auck, Tucson, Ark.

[73] Assignee: UOP Inc., Des Plaines, Ill.

[21] Appl. No.: 952,503

[22] Filed: Oct. 18, 1978

[51] Int. Cl.[2] ..... C22B 15/10; C22B 23/04

[52] U.S. Cl. ..... 75/91; 75/7; 75/21; 75/25; 75/103; 75/104; 75/117; 75/119

[58] Field of Search ..... 75/7, 21, 25, 91, 117, 75/119, 103, 104

[56] References Cited

U.S. PATENT DOCUMENTS

| | | | |
|---|---|---|---|
| 2,556,215 | 6/1951 | Queneau et al. | 75/91 X |
| 3,367,740 | 2/1968 | Zubryckyj et al. | 75/119 X |
| 3,661,564 | 5/1972 | Gandon et al. | 75/101 BE X |
| 3,772,423 | 11/1973 | Stevens et al. | 75/119 X |
| 3,772,424 | 11/1973 | Stevens et al. | 75/119 X |
| 3,845,189 | 10/1974 | M iller et al. | 75/119 X |

*Primary Examiner*—G. Ozaki

*Attorney, Agent, or Firm*—James R. Hoatson, Jr.; Raymond H. Nelson; William H. Page, II

[57] ABSTRACT

The present process involves an improvement in the hydrometallurgical recovery of metal values from metal bearing sources such as ores and the like. When subjecting a metal bearing source to a reductive roast in a reducing atmosphere followed by cooling the reduced metal bearing source, extracting the cooled source and recovering the resultant nickel value, it is possible to utilize a smaller amount of an additive which assists in the recovery of metal values by scrubbing the off-gases from the reductive roast utilizing a fresh metal bearing source feed as the scrubbing material.

12 Claims, 1 Drawing Figure

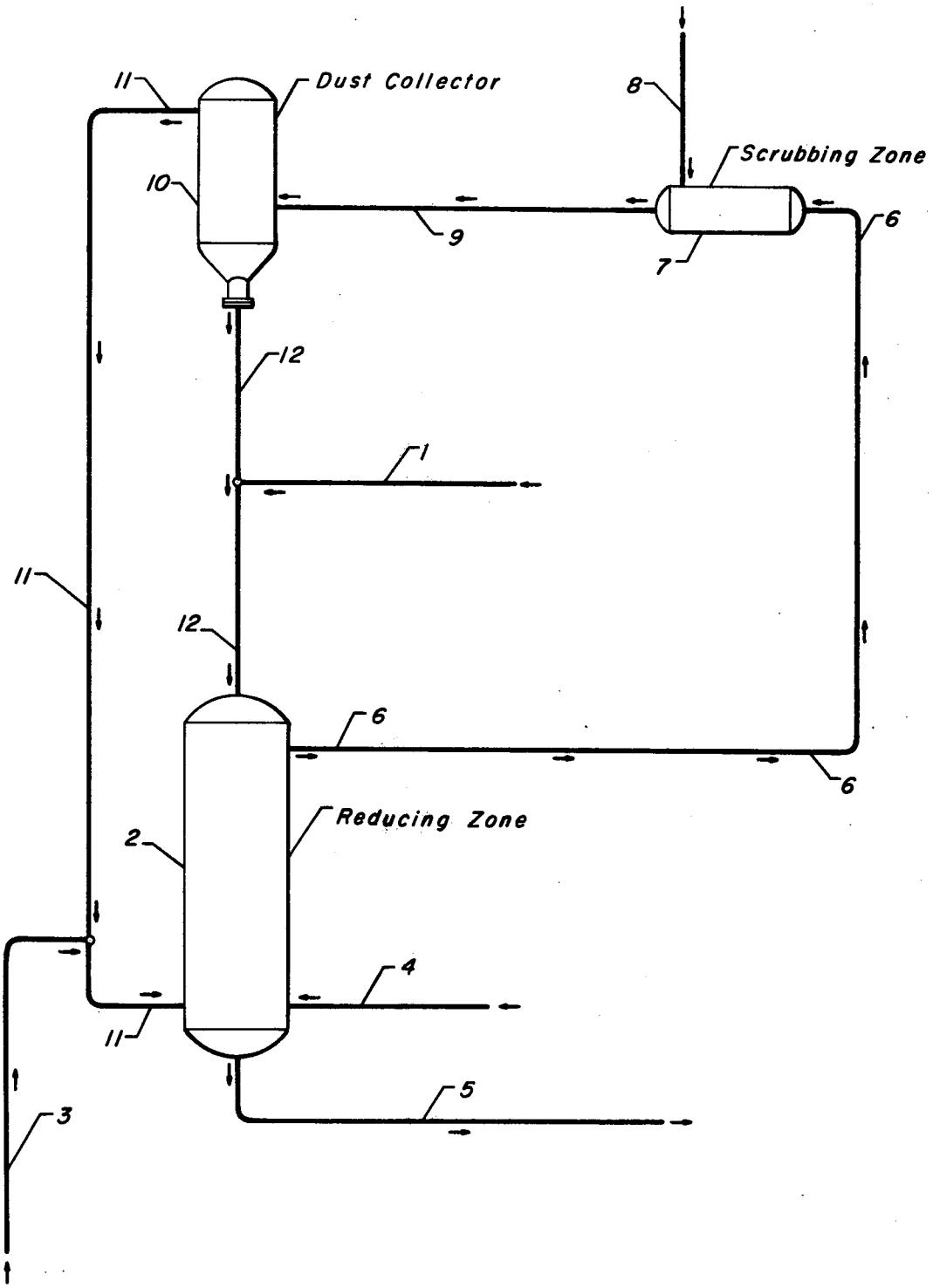
Dust Collector
Scrubbing Zone
Reducing Zone
11
10
9
8
7
6
12
1
2
4
5
3

HYDROMETALLURGICAL RECOVERY OF METAL VALUES

BACKGROUND OF THE INVENTION

In the processing of materials containing metal values, two of the main extractive methods to be considered are pyrometallurgy and hydrometallurgy. In the former, metal-containing material such as ore, slag, scrap, etc., is heated with appropriate agents such as reducing agents, fluxing agents, sulfidizing agents, chloridizing agents and/or oxidizing agents, etc., usually to the melting or fusion point of the mixture. At this temperature there is generally a separation of metallic values from gangue or waste materials. The procedure then calls for separating the metallic values from slag or waste material at a temperature at which both are molten. The phase containing the metal value is then cast to some convenient shape for use or for further refining, whichever is appropriate for the particular system involved. The very high temperatures involved in this technique are achieved via electric furnaces, blast furnaces, reverberatory furnaces, etc. Temperatures required for metals such as copper, nickel, iron would generally range from 1000° C. to 2000° C. An advantage in this method is that recoveries of the metal values are typically quite high.

The hydrometallurgy approach differs substantially from pyrometallurgy in that, although the metal bearing material such as ore, slag, scap, etc., may be heated with agents such as reducing agents, oxidizing agents, sulfidizing and chloridizing agents as part of the procedure, the temperatures involved are generally much lower than with the usual pyrometallurgical method. These temperatures typically may be 260° C. to about 1040° C., temperatures generally well below the fusion point of the metal-containing material.

Following this step, the treated metal-containing material then is contacted with an appropriate aqueous solution for extracting metal values by dissolution. The metal is then removed from the solution by precipitation, solvent extraction, evaporation of solvent, etc. The metal-containing residue obtained is then handled appropriately to further refine the metal. Although conditions of temperature are generally much lower than in pyrometallurgy, it is frequently found that recovery of the metal values is also lower than in the pyrometallurgical method.

A particular case where this is true concerns the extraction of nickel from lateritic nickel ores. The pyrometallurgical processes range from the use of an electric furnace for the direct smelting of ore to produce ferronickel through similar techniques involving the blast furnace in which an iron-nickel-sulfide matter is obtained. The extraction of nickel from the ore using this method is greater than 90%.

Of the several hydrometallurgy approaches used commercially for treating this type of ore, the practice on a limonite ore or a highly serpertinic ore, such as that at Nicaro, Cuba, involves roasting the ore in a multihearth furnace while a reducing gas, such as producer gas, passes countercurrent to the ore. Temperatures in this case range from about 485° C. to about 735° C. Following the roasting step, the ore is cooled in the absence of air, mixed with an ammoniacal ammonium carbonate solution and vigorously agitated and aerated. This results in the dissolution of nickel, copper, and cobalt, separating them from the bulk of the core. This solution then is treated with steam, driving off ammonia and precipitating nickel carbonate. This product then is treated further to obtain the appropriate form of nickel or use as such. In comparison to the pyrometallurgical process, however, extractions using this method have only been of the order of 70 to 80 percent.

Several other hydrometallurgy methods involve the use of procedures which include a roasting step with chlorides or sulfates but in other than reducing atmospheres and in such a manner as to form soluble metal salts, and the roasted ore is leached with an appropriate solvent such as dilute sulfuric acid. Alternatively, in certain cases the ore can be leached directly, such as with sulfuric acid solution but this is practical only when the magnesia content of the ore is low.

The extraction of metal values from metal bearing sources may be improved when the reductive roast is effected in the presence of certain additives such as added halides, added sulfur, added sulfur-containing compounds or combinations of these additives. The addition of these additives in which the metal bearing source is pretreated with the additive is known in the trade as "pugging" step. Normally, when utilizing a halide, the pugging step introduces a large amount of water into the process. As will hereinafter be shown, it has now been discovered that only a portion of the metal bearing source which is the feed for the process need be contacted with the required amount of additive thereby permitting a sizable reduction of the amount of water which is required and concurrently permitting conservation of energy and the use of less expensive corrosion resistant equipment. One means of accomplishing this is to utilize a portion of the ore feed as a dry scrubbing medium for the off-gases from the reductive roast of the ore.

U.S. Pat. No. 3,661,564 discloses a chloridizing roast at temperatures ranging from about 250° to about 350° C. in which the patentee adds a sufficient amount of chlorides such as hydrochloric acid to a minor portion of a lateritic ore so that when the minor portion is added to the major portion of the ore there is enough total chloride present to totally chlorinate the metal values of interest such as the nickel, copper, and cobalt and to form soluble nickel chloride, copper chloride, and cobalt chlorides. The purpose of this procedure is to permit the extraction of those metal values from the ore by a simple aqueous leach. This is in contradistinction to the object of the present invention to which the minor portion of the feed when treated with at least one additive and combined with a major portion of the feed is reductively roasted at a temperature which is sufficient to destroy any soluble salts which might have been formed. In addition, the procedure also increases eventual metal value recovery and can be employed on a wider range of ore compositions.

SPECIFICATION

This invention relates to an improvement in the process for the extraction of metal values from metal bearing sources. More specifically, the invention is concerned with an improvement in a process for the recovery of metal values from metal bearing sources in which the source is heated in a reducing atmosphere containing additives, said additives enhance the effectiveness of the reductive roast whereby the recovery of the desired metal value is improved. By dry scrubbing the off-gases which result from the reductive roast, it is possible to recover the additives and, by utilizing a fresh ore feed source as the scrubbing material, to pretreat the feed source with the recovered additives.

As hereinbefore set forth the hydrometallurgical extraction of metal values has been found to be improved when the reductive roast of the metal bearing source is effected in the presence of additives comprising added halides, added solid sulfur, added sulfur-containing compounds or combinations thereof. While the exact reason for the improved results or the mechanism by which they are accomplished are not known, several explanations therefor may be offered, with the understanding that the applicants do not intend to be limited thereto. One explanation is that the additives may act to reduce or to facilitate reduction of the combined metal or to otherwise assist in liberating the metal, whereby it is readily extractable. Another explanation is that the combination of additives may act or facilitate such action to reduce the metals in an iron metal alloy to thereby convert the metals into a readily extractable form. Still another explanation is that the combination of additives may act to prevent recombination of the metal into a form in which it is less readily extractable.

It is recognized that different ores respond differently to different additives and that greater improvement in the recovery of metal values may be obtained with some when the roasting is conducted in contact with a mixture of added gaseous sulfur compound and added sulfur or in contact with added gaseous sulfur compound and added halides or when the roasting is effected in contact with all three of these additives. Also, it is recognized that some added gasous sulfur compounds will respond differently in this system than other added gasous sulfur compounds. Accordingly, the specific added gasous sulfur compound and added sulfur and/or added halide will be selected with reference to the particular ore to be processed.

As hereinbefore set forth, improved recovery of metal values is obtained when the roasting of the metal-containing material such as ore, slag, scrap, etc., is effected in contact with additives such as gaseous sulfur compounds, added solid sulfur, and/or added halides, whereby the recovery of the metal value is effected in a considerably higher yield than heretofore obtained in the hydrometallurgical system.

The process of the present invention may be used for the recovery of metal values from ore, slag, scrap or other metal bearing source and is particularly applicable to the recovery of nickel from such sources. However, it is to be understood that the process may be used for the recovery of other metal values including, for example, cobalt, copper, manganese and other metals which are soluble in ammoniacal solutions, but not necessarily with equivalent results. In the interest of brevity, the following discussion will be directed to the recovery of nickel, with the understanding that it may be applied to the recovery of other metals as hereinbefore set forth.

As another advantage to the present invention, the process may be conducted in conventional apparatus and may utilize much of the conventional steps or prior art processes. Accordingly, the ore such as a lateritic nickel ore or other metal bearing source is prepared in a manner suitable for the process, such as finely divided or comminuted particles in a conventional way. The particles may be within a size range of from about 4 mesh to about 500 mesh or smaller and preferably within a range of from about 48 mesh to about 200 mesh. The particles then preferably are dried in a conventional manner to lower the moisture content of from about the usual 25% to 50% down to about 3% or 10% or less. The drying generally is effected in a rotary kiln at conventional temperatures.

The added sulfur compound will be used in a sufficient concentration for the purpose and may be within the range of from about 0.01% to about 10% and preferably from about 0.1% to about 5% by weight of the ore. Any suitable gaseous sulfur compound may be used in the present invention. Preferred gaseous sulfur compounds comprise hydrogen sulfide, sulfur dioxide, sulfur trioxide, carbonyl sulfide, carbon monosulfide, carbon disulfide, etc. For ease of use, the added sulfur compound preferably is normally in gaseous form. In addition, the solid sulfur which may, if so desired, be used will be in solid forms including powder, flour, granules, pellets, etc. Generally speaking, the sulfur is employed in a concentration of from about 0.01% to about 5%, and preferably from about 0.15% to about 3% by weight of the ore. When the additive comprises a hydrogen halide the hydrogen halide is used in a concentration of from about 0.01% to about 10% and preferably from about 0.1 to about 5% by weight of the ore. Any hydrogen halide gas may be used, and preferably comprises hydrogen chloride or hydrogen bromide although it is also contemplated within the scope of this invention that hydrogen iodide or hydrogen fluoride may also be employed but not necessarily with equivalent results. In still another embodiment, a precursor of hydrogen halide may be used and may be selected from free halogen, chlorine, bromine, iodine, fluorine or other suitable compounds selected from metal halides, boron halides, carbon halides, phosphorous halides, silicone halides, etc.

In the preferred embodiment the additives are in gaseous form in order to utilize a dry system for the hydrometallurgical recovery of the metal values. The use of a dry system possesses several advantages of a wet system. For example, a wet system will utilize more costly or expensive equipment and, in addition, will also entail higher operating costs such as that required for fuel. In a wet system, a sufficient amount of heat must be added to remove any moisture which is present in the system. A dry system is non-corrosive in nature as opposed to a potential corrosion problem which may arise when employing wet acids as additives for the process. Other advantages which are found when employing a dry system in the process entails the potential which is present to recover a higher percentage of additives for reuse than is possible when employing a wet system. In addition, another potential which exists is the higher recovery of metal values due to a higher extraction of the desired metal from the metal bearing source.

It is therefore an object of this invention to provide an improved process for the recovery of metal values from a metal bearing source.

A further object of this invention is found in an improvement in a process for effecting the recovery of metal values from a metal bearing source by utilizing a fresh feed source as scrubbing material for the dry scrubbing of off-gases from the reductive roasting step of the process.

In one aspect an embodiment of this invention resides in a process for the recovery of metal values from a metal bearing source wherein said metal bearing source is subjected to a reductive roast in an appropriate reducing atmosphere in contact with at least one additive, cooling the reduced metal bearing source, extracting the cooled reduced metal bearing source, and recovering the resulting metal value, the improvement which comprises utilizing a fresh metal bearing source feed as a scrubbing material to dry scrub the off-gas stream from said reductive roast to remove additives present in said stream.

A specific embodiment of this invention is found in a process for the recovery of metal values from a metal bearing source which comprises subjecting a metal bearing source such as a lateritic ore to a reductive roast in an appropriate reducing atmosphere at a temperature in the range of from about 500° to about 1000° C. in contact with hydrogen chloride, cooling the reduced metal bearing source, extracting the cooled source and recovering the desired nickel, the off-gas stream from the reducive roast being dry scrubbed to remove the hydrogen chloride present in said stream, the scrubbing material which is used to remove the hydrogen chloride being a fresh lateritic ore source feed.

Other objects and embodiment will be found in the following further detailed description of the present invention.

In accordance with the present invention, the extraction of metal values from a metal bearing source may be effected in a more readily economical manner by utilizing a lesser amount of additive in the reductive roast step of the total process. This saving of the amount of additive which is required to obtain the desired metal value is effected in a manner hereinafter set forth in greater detail in which the off-gases which are obtained from the reductive roast of the feed stock are dry scrubbed utilizing fresh feed stock as the scrubbing material.

The process is effected by subjecting the feed stock which may comprise an ore such as a laterite ore to a grinding or crushing step in which the feed stock is ground to the desired particle size, said grinding means including a ball mill or any other type of crushing or grinding apparatus which is known in the art. Thereafter the feed stock is then subjected to a reductive roast, the chemical reduction of the ore being effected by means of an appropriate reducing atmosphere which is of the general type used in conventional processes. Any suitable appropriate reducing gas mixture may be used, and preferably comprises a mixture of hydrogen, carbon monoxide, carbon dioxide and water vapor. The gas mixture may come from any suitable source including producer gas, gases formed by the combustion of city gas, gases formed by the combustion of oil, coal, etc., the specific gas mixture being selected to effect the desired reduction. An illustrative gas mixture comprises a $CO:CO_2$ ratio within the range of about 0.1:1 to 10:1, a $CO:H_2$ ratio of about 0.1:1 to 10:1 and a $H_2:H_2O$ vapor ratio of about 0.1:1 to 10:1, all being on a volumetric basis. In one embodiment, it is desirable to maintain the gas mixture within the ratios set forth above because an excessive concentration of one or more of the components in the gas mixture may have undesired effects such as, for example, incomplete reduction of the metal compound, excessive adsorption of the gas in the ore particles, etc. It is understood that the gas mixture may contain other components as, for example, nitrogen, when advantages appear therefor. Another illustrative gas mixture comprises hydrogen, nitrogen and water vapor. Still another gas mixture may comprise natural gas or a gas such as carbon monoxide may be employed.

The reduction of the metal compounds to the free metal is effected at a temperature in the range of from about 500° to about 1000° C. and preferably in a range of from about 650° to about 900° C. This temperature which is utilized in the reduction avoids the objections inherently present in the prior art high temperature reduction processes and at the same time is sufficiently high to decompose any soluble metal salts such as metal chlorides present. Also, the reduction is effected in a relatively short period of time and thus further constitutes another advantage to the novel method of the present invention.

The off-gases which are withdrawn from the reducing zone and which contain the additives in the form of halides, halogens, sulfur dioxide or hydrogen sulfide are passed through a scrubbing zone wherein they are scrubbed by contact with a scrubbing material which comprises fresh feed stock, said fresh feed stock being ground metal bearing source. The off-gas is scrubbed in a dry manner at temperatures ranging from about 100° to about 500° C. and preferably in a range of from about 150° to about 400° C. The mixture of fresh feed stock and off-gases after scrubbing thereof are passed to a dust collector wherein the clean off-gases which contain no additives, the additives having been adsorbed or entrained on the feed stock, are separated. The fresh feed stock which contains the volatile additives on the feed or by the reaction of chloridization, adsorption, condensation, neutralization, etc., is also withdrawn from the dust collector and passed to the reducing zone. If so desired, an additional portion of fresh feed stock may be admixed with the treated feed stock prior to admission to the reducing zone and the combined total is then charged to the reducing zone for reaction at the aforesaid temperature of from 600° to 1000° C. in a reducing atmosphere.

The reduced ore particles are withdrawn from the reducing zone and then processed in conventional manner for the hydrometallurgical extraction of the nickel. The effluent from the reduction zone is first cooled several hundred degrees and then is passed into one or more quench zones. In a preferred embodiment the quench liquid is the ammonium carbonate leaching solution. However, the quenching must be effected in the absence of air. In other words, oxygen or air should not contact the reduced particles until the temperature of the particles is below about 95° C. because of the possiblity of oxidation of the metal to the oxide or to other oxygen-containing compounds. It is understood that other suitable quenching solutions may be employed but, as hereinbefore set forth, economical advantages appear for the use of the leaching solution.

Any suitable leaching solution may be employed and preferably comprises aqueous ammonium carbonate solution containing from about 2% to about 25% and preferably from about 3% to about 15% $NH_3$ and from about 1% to about 15% and preferably from about 1.5% to about 7.5% $CO_2$. As still another advantage to the process of the present invention, the leaching solution comprises a lower concentration of $NH_3$ than generally is utilized in the prior art, thus effecting an additional economy in the present process. The leaching is effected at a temperature below 95° C. and conveniently ambient temperature. Ambient pressure or superatmospheric pressure may be used but generally will not exceed about 100 psig. As hereinbefore set forth, the leaching is effected in the presence of oxygen, which may comprise ambient air when the leaching is effected in open tanks or vessels or it may comprise air introduced into closed zones. It is understood that, in the place of air, oxygen or other suitable oxygen-containing source may be utilized.

The solution of nickel which is withdrawn from the leaching and thickening zones is then treated in any suitable manner to precipitate the nickel and recover the same. In one method, this is accomplished by steaming whereby the nickel carbonate is precipitated and the ammonia, carbon dioxide and water are volatilized. Thereafter the precipitated nickel carbonate can be treated in any conventional manner to recover the desired metal.

BRIEF DESCRIPTION OF THE DRAWING

The present process will be further illustrated with reference to the accompanying FIGURE which illustrates a simplified flow diagram of the inventive feature of the present process. Various valves, coolers, condensers, pumps, controllers, etc., have been eliminated as not being essential to the complete understanding of the present invention. The illustration of these, as well as other essential appurtenances will become obvious as the drawing is described.

Referring now to the FIGURE, a feed stock comprising a metal bearing source such as an ore is charged through line 1 to a reducing zone 2. In reducing zone 2 the ore, which has been ground to the desired particle size is subjected to a reductive roast at a temperature in the range of from about 600° to about 1000° C. in a reducing atmosphere which is provided for by the introduction of a reductant through line 3. The ore is in contact with an additive which is also introduced into reducing zone 2 through line 4. After being subjected to a reductive roast for a predetermined period of time, the reduced ore is withdrawn through line 5 and passed to quench zone after having been cooled wherein it is subjected to a leaching solution of the type hereinbefore set forth in greater detail. After leaching, the solution is then withdrawn and treated in a manner suitable to precipitate the nickel and recover the same. The off-gases from reducing zone 2 are withdrawn through line 6 and passed to scrubbing zone 7. The off-gases which contain carbon monoxide, carbon dioxide, hydrogen, nitrogen, as well as gaseous halogen, hydrogen halide, sulfur dioxide and/or hydrogen sulfide depending upon the additive or combination of additives which were added through line 4 may be cooled to a temperature in the range of from about 100° to about 500° C. In scrubbing zone 7 the off-gases are dry scrubbed using a fresh ore feed stock which is charged to scrubbing zone 7 through line 8. After undergoing the scrubbing operation the mixture of off-gases which contain no additives such as hydrogen halide, hydrogen sulfide, etc., in admixture with the ore which has the additives adsorbed thereon are withdrawn from scrubbing zone 7 through line 9 and passed to dust collector 10. In dust collector 10 the clean off-gases are withdrawn through line 11 and recycled back to reducing zone 2. If necessary, additional amounts of the reducing gas comprising a mixture of carbon monoxide, carbon dioxide, hydrogen, nitrogen and water vapor are added through line 3 for admixture with clean off-gas in line 11 and the resulting mixture charged to reducing zone 2 in a single stream. As an alternative, if so desired, the clean off-gases from dust collector 10 may be withdrawn without being recycled back to reducing zone 2 and passes to storage or disposed of in any predetermined manner. The additive-treated ore feed stock is withdrawn from dust collector 10 through line 12 and passed into reducing zone 2 for the reductive roast treatment. If so desired, additional amounts of ore which have been ground or crushed to the desired particle size may be charged through line 1 and admixed with the treated feed stock in line 12 and the resulting admixture charged to reducing zone 2 in a single stream. As hereinbefore set forth by utilizing a fresh feed stock as the scrubbing material for dry scrubbing the off-gases from the reducing zone, it will be possible to effect an economical recovery of the desired metal values while utilizing a smaller amount of additives which permit the recovery of the metal value.

The following example is given to illustrate the process of the present invention. However, it is to be understood that this example is given merely for purposes of illustration and is not intended to limit the generally broad scope of the invention is strict accordance therewith.

EXAMPLE

To illustrate the feasibility of utilizing feed stock ore as a dry scrubbing material for the removal of additives from an off-gas stream and the ability of the dry additive to enhance the recover of metal values, an experiment was performed in which 25 grams of an ore which had the following approximate weight percent composition assay on a dry basis:

Ni:1.24
Co:0.14
Fe:36.9
$SiO_2$:14.7
$Al_2O_3$:2.1 was used for dry scrubbing by passing a nitrogen-hydrogen chloride gas stream through the ore bed at a temperature of 200° C. for a period of time sufficient to load the ore with chloride loadings ranging from 2 to 4%. The chloride loaded ore was then subjected to reductive roast by passing a reducing gas which had the following composition:

30%$H_2$
10%CO
22%$CO_2$
38%$N_2$ over the chloride treated ore at a temperature ranging from 350° to 800° C. for a period of ½ hour, the ore being slowly tumbled during the reductive roast. Following the reductive roast the reduced ore was then subjected to an ammoniacal ammonium carbonate extraction in the manner known in the art to obtain the percentage of nickel and the percentage of cobalt which were extracted from the ore. In addition, a similar test was performed with the exception that the ore was pugged with liquid hydrochloric acid in the manner known in the art before subjecting the ore to the reductive roast and ammoniacal ammonium carbonate extraction. The results of these tests are set forth in the Table below:

TABLE

| Gaseous Hydrogen Chloride Chloride Loading-Wt. % | Nickel Extraction % |
|---|---|
| 2.0 | 87.2 |
| 2.9 | 90.1 |
| 4.0 | 89.1 |
| 4% Liquid Hydrochloric Acid Pug | 90 |

It is readily apparent from the above table that tests indicate, under identical conditions, the 2.9% loaded chloride performed as well as the 4% chloride sample which was loaded by wet pugging. This example indicates that it is possible to remove hydrogen chloride or other volatile chlorides from the nickel reduction roast off-gas stream using fresh laterite ore as an absorption medium and by utilizing this fresh ore as a scrubbing medium, it will remove chlorides from the off-gases and permit reclamation of the chloride as an active ingredient by absorption onto the ore and thus eliminate the wet hydrochloric acid pugging step. In addition, it will also permit the recycle and reuse of an expensive reagent, thereby lowering the cost of the overall process. In addition, by utilizing this dry scrubbing method, it is possible to effect the extraction of metal values from metal bearing sources by utilizing a smaller amount of additives than is possible when utilizing the known wet methods.

We claim as our invention:

1. In a process for the recovery of metal values from a metal bearing source wherein said metal bearing source is subjected to a reductive roast in an appropriate reducing atmosphere in contact with at least one additive, cooling the reduced metal bearing source, extracting the cooled reduced metal bearing source, and recovering the resultant metal value, the improvement which comprises dry scrubbing the off-gas stream from said reductive roast with fresh metal bearing source to remove additive from said stream, and supplying the resultant additive-containing fresh metal bearing source to said reductive roast.

2. The process of claim 1 wherein said off-gas stream is scrubbed with the total fresh metal bearing source feed for the reductive roast.

3. The process as set forth in claim 1 in which said additive is hydrogen chloride gas.

4. The process as set forth in claim 1 in which said additive is sulfur dioxide gas.

5. The process as set forth in claim 1 in which said additive is hydrogen sulfide gas.

6. The process as set forth in claim 1 in which said additive is a combination of halides and sulfur compounds in a gaseous form.

7. The process as set forth in claim 1 in which said metal bearing source is a laterite ore.

8. The process as set forth in claim 1 in which said metal value is nickel.

9. The process as set forth in claim 1 in which said metal value is copper.

10. The process as set forth in claim 1 in which said metal value is cobalt.

11. The process as set forth in claim 1 in which said reductive roast is effected at a temperature in the range of from about 500° to about 1000° C.

12. The process as set forth in claim 1 in which said dry scrub is effected at a temperature in the range of from about 50° to about 600° C.

* * * * *

UNITED STATES PATENT AND TRADEMARK OFFICE

CERTIFICATE OF CORRECTION

PATENT NO. : 4,200,455

DATED : April 29, 1980

INVENTOR(S) : James A. Bradbury et al.

It is certified that error appears in the above—identified patent and that said Letters Patent is hereby corrected as shown below:

Inventors: James A. Bradbury, Tucson, Az.;

John C. Stauter, Edmond, Okla.;

Richard T. Um, Tucson, Az.;

Frank A. Stephens, Tucson, Az.;

Yoon T. Auck, Tucson, Az.

Signed and Sealed this

*First* Day of *July 1980*

[SEAL]

*Attest:*

SIDNEY A. DIAMOND

*Attesting Officer*

*Commissioner of Patents and Trademarks*